US009263836B2

(12) United States Patent
Zhao et al.

(10) Patent No.: US 9,263,836 B2
(45) Date of Patent: Feb. 16, 2016

(54) ELECTRICAL CONNECTOR REDUCING ANTENNA INTERFERENCE

(71) Applicant: FOXCONN INTERCONNECT TECHNOLOGY LIMITED, Grand Cayman (KY)

(72) Inventors: Jun Zhao, Kunshan (CN); Jing-Jie Guo, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/604,648

(22) Filed: Jan. 23, 2015

(65) Prior Publication Data

US 2015/0207273 A1 Jul. 23, 2015

(30) Foreign Application Priority Data

Jan. 23, 2014 (CN) ..... 2014 1 0031246
Jul. 1, 2014 (CN) ..... 2014 2 0357954

(51) Int. Cl.

| | |
|---|---|
| ***H01R 13/648*** | (2006.01) |
| ***H01R 24/60*** | (2011.01) |
| ***H01R 13/6594*** | (2011.01) |
| *H01R 12/72* | (2011.01) |
| *H01R 13/6582* | (2011.01) |

(52) U.S. Cl.
CPC ..... *H01R 24/60* (2013.01); *H01R 13/6594* (2013.01); *H01R 12/72* (2013.01); *H01R 13/6582* (2013.01)

(58) Field of Classification Search
CPC ..... H01R 13/65802; H01R 13/658; H01R 23/6873; H01R 23/7073
USPC ..... 439/607.4, 607.27, 607.35
See application file for complete search history.

(56) References Cited

U.S. PATENT DOCUMENTS

| | | | | |
|---|---|---|---|---|
| 5,637,015 | A * | 6/1997 | Tan | H01R 23/6873 439/607.37 |
| 7,997,937 | B2 * | 8/2011 | Kondo | H01R 13/6477 439/607.4 |
| 8,801,463 | B2 * | 8/2014 | Tan | H01R 13/5202 439/607.04 |
| 8,845,363 | B2 | 9/2014 | Ardisana, II et al. | |
| 9,112,299 | B2 * | 8/2015 | Lu | H01R 13/5227 |

FOREIGN PATENT DOCUMENTS

| | | |
|---|---|---|
| CN | 201904481 | 7/2011 |
| JP | 4875130 | 5/2011 |
| KR | 10-1355579 | 7/2013 |

* cited by examiner

*Primary Examiner* — Phuong Dinh
(74) *Attorney, Agent, or Firm* — Wei Te Chung; Ming Chieh Chang

(57) ABSTRACT

An electrical connector (100) includes an insulative body (2), a number of contacts (1), and a metal shell (5). The insulative body includes an upper wall (21), a lower wall (22), a pair of sidewalls (23), and a rear wall (24) connecting between the upper wall, the lower wall, and the sidewalls for cooperatively defining a receiving space (20). The insulative body has a mating tongue (25) extending forwardly from the rear wall into the receiving space. The contacts are retained in the mating tongue and partly exposed in the receiving space. The metal shell has a length along a front-and-rear direction smaller than that of the receiving space. The metal shell has a length along a front-and-rear direction smaller than that of the receiving space so as to be positioned on a front part of the lower wall for reducing interference between the metal shell and an antenna.

17 Claims, 9 Drawing Sheets

ELECTRICAL CONNECTOR REDUCING ANTENNA INTERFERENCE

CROSS-REFERENCE TO RELATED APPLICATIONS

This patent application relates to a concurrently filed U.S. patent application entitled "ELECTRICAL CONNECTOR BOTH PREVENTING SCRAPPING TO AN INSULATIVE BODY AND REDUCING ANTENNA INTERFERENCE," which is assigned to the same assignee as this application.

BACKGROUND OF THE INVENTION

1. Field of the Invention

The present invention relates generally to an electrical connector, and more particularly to an electrical connector reducing antenna interference.

2. Description of Related Arts

Japan Pat. No. 4875130 issued to Hirose on 2011 Dec. 2 discloses an electrical connector comprising a metal shield with a receiving space, a plurality of contacts received in the receiving space of the metal shield, and an insulative body molding over the metal shield and retaining the contacts. The metal shield together with the contacts is insert-molded in one-shot via the insulative body. The insulative body forms an insulative cover adhering to an outside surface of the metal shield and a tongue portion extending forwardly into the receiving space for supporting the contacts. The metal shield usually has a large length along an insertion direction to extend from an insertion opening to an inner connecting surface between the insulative cover and the insulative body. The metal shield usually has a plurality of grounding tails to be soldered with a printed circuit board of an electronic device such as a mobile phone which usually has an antenna for both transmitting and receiving signals. Therefore, the metal shield has an antenna interference issue because a small distance between the metal shield and the antenna when the electrical connector is assembled on the printed circuit board of the electronic device.

U.S. Pat. No. 8,845,363 issued to Ardisana, II et al. on 2014 Sep. 30 discloses an electronic device including a receptacle connector. Reinforcing element may be embedded within an upper portion of shell adjacent to antenna of device. As the position of antenna may vary among electronic devices, so may the position of reinforcing element vary to be adjacent to antenna and embedded in shell. Some embodiments disclosed relate to improved receptacle connector shells that can provide for a smaller, stronger receptacle connector shell, increased Electromagnetic Interference and Electromagnetic Compatibility performance ("EMI/EMC performance"), and increased flexibility in the positioning of an antenna within the enclosure of an electronic device.

An electrical connector reducing antenna interference is desired.

SUMMARY OF THE INVENTION

Accordingly, an object of the present invention is to provide an electrical connector reducing antenna interference.

To achieve the above object, an electrical connector includes an insulative body, a number of contacts, and a metal shell. The insulative body includes an upper wall, a lower wall, a pair of sidewalls, and a rear wall connecting between the upper wall, the lower wall, and the sidewalls for cooperatively defining a receiving space. The insulative body has a mating tongue extending forwardly from the rear wall into the receiving space. The contacts are retained in the mating tongue and partly exposed in the receiving space. The metal shell having a length along a front-and-rear direction smaller than that of the receiving space so as to be positioned on a front part of the lower wall for reducing interference between the metal shell and an antenna Other objects, advantages and novel features of the invention will become more apparent from the following detailed description when taken in conjunction with the accompanying drawings.

DETAILED DESCRIPTION OF THE PREFERRED EMBODIMENT

Figure 1:
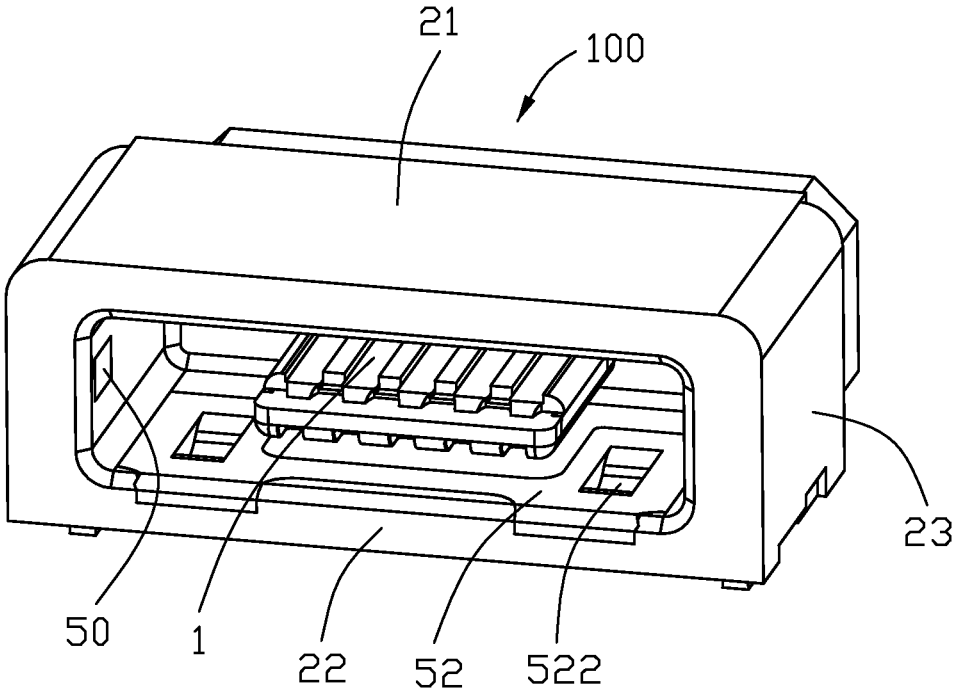
FIG. 1 is a perspective, assembled view of an electrical connector in a first embodiment constructed in accordance with the present invention.
Figure 2:
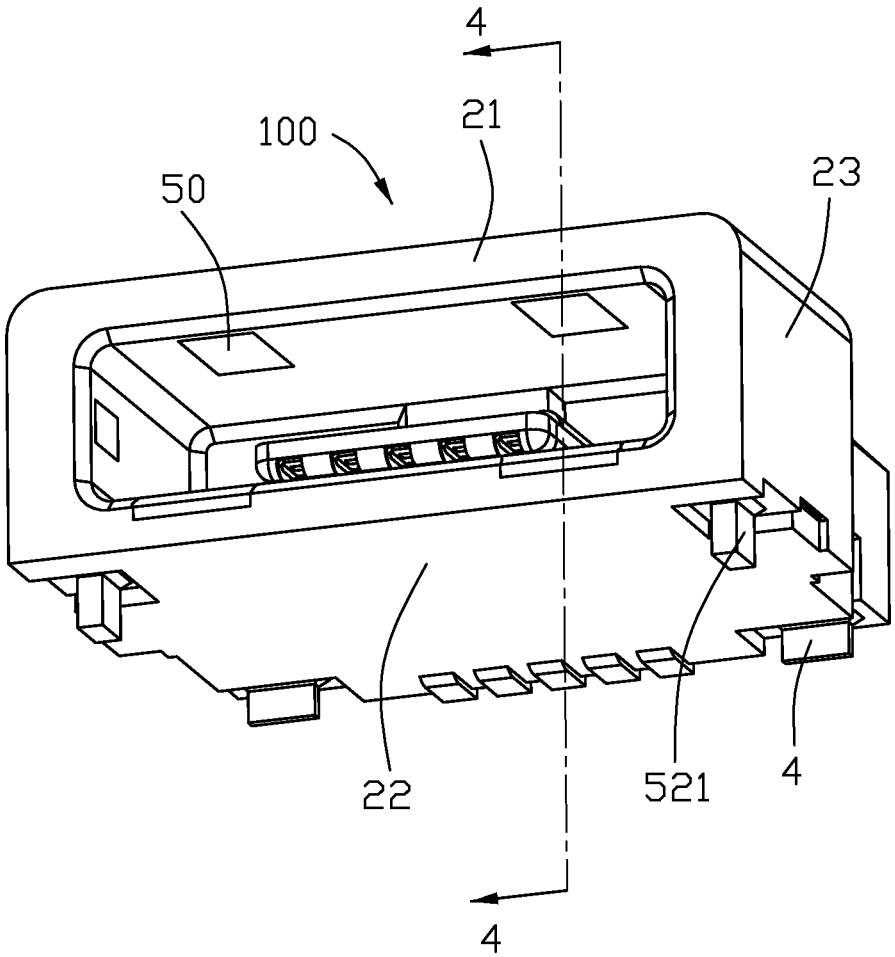
FIG. 2 is similar to but taken a different view from FIG. 1.

Reference will now be made in detail to the preferred embodiment of the present invention.

Referring to FIGS. 1-5, an electrical connector 100 of the present invention in a first embodiment, used for receiving a mating plug connector (not shown), comprises a plurality of contacts 1, an insulative body or housing 2 defining an receiving space 20 for receiving the contacts 1 and having a mating tongue 25 extending into the receiving space 20 for retaining the contacts 1, a reinforcing plate 3 retained in the mating tongue 25 for reinforcing the mating tongue 25, a pair of grounding plates 4 retained in a rear part of the insulative body 2, and a metal shell 5 retained at a front part of the insulative body 2 and partly exposed into the receiving space 20 for engaging with the mating plug connector and preventing the insulative body 2 from being scrapped by the mating plug connector.

Figure 5:
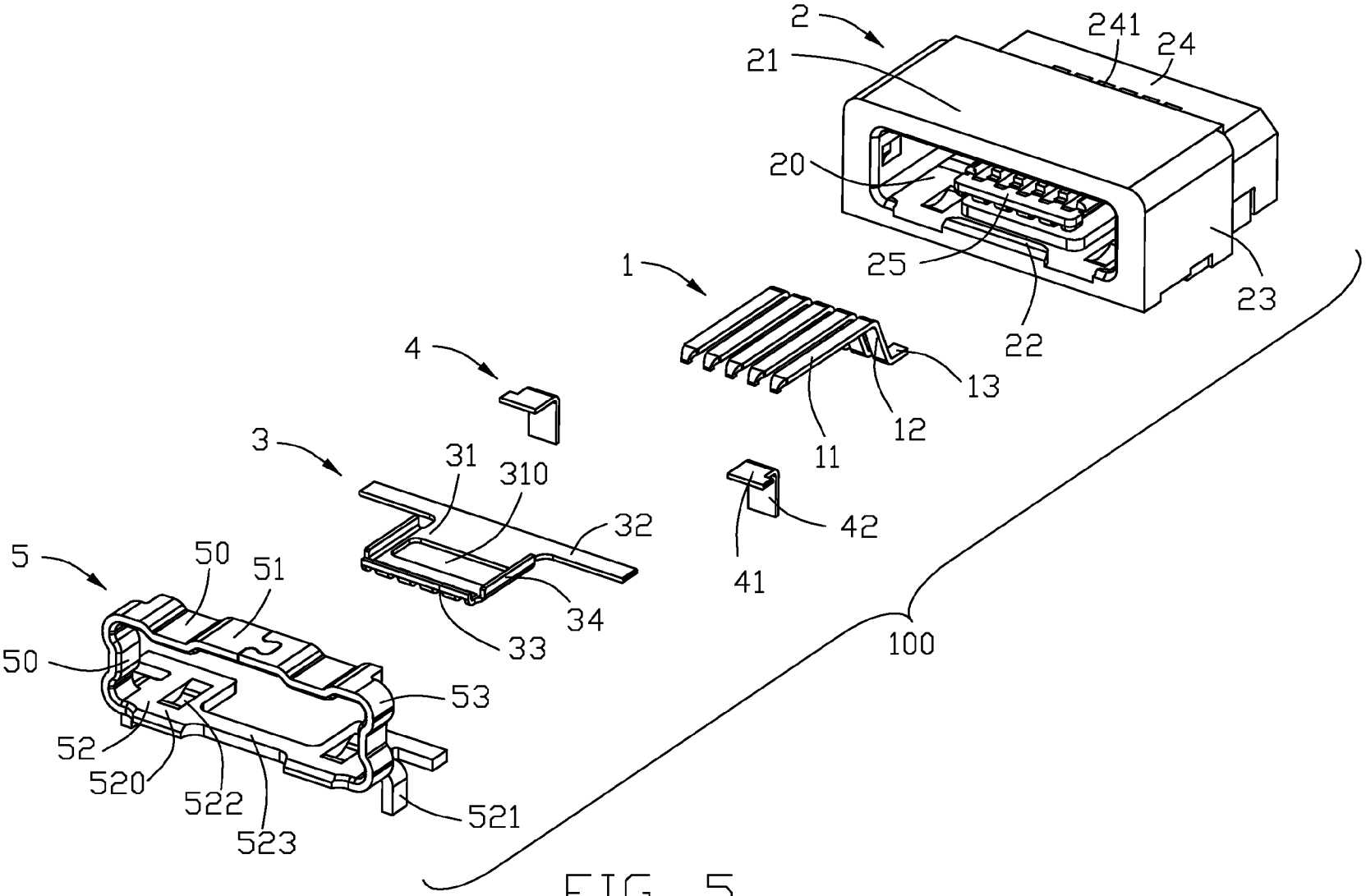
FIG. 5 is a perspective, exploded view of the electrical connector of FIG. 1.
Figure 6:
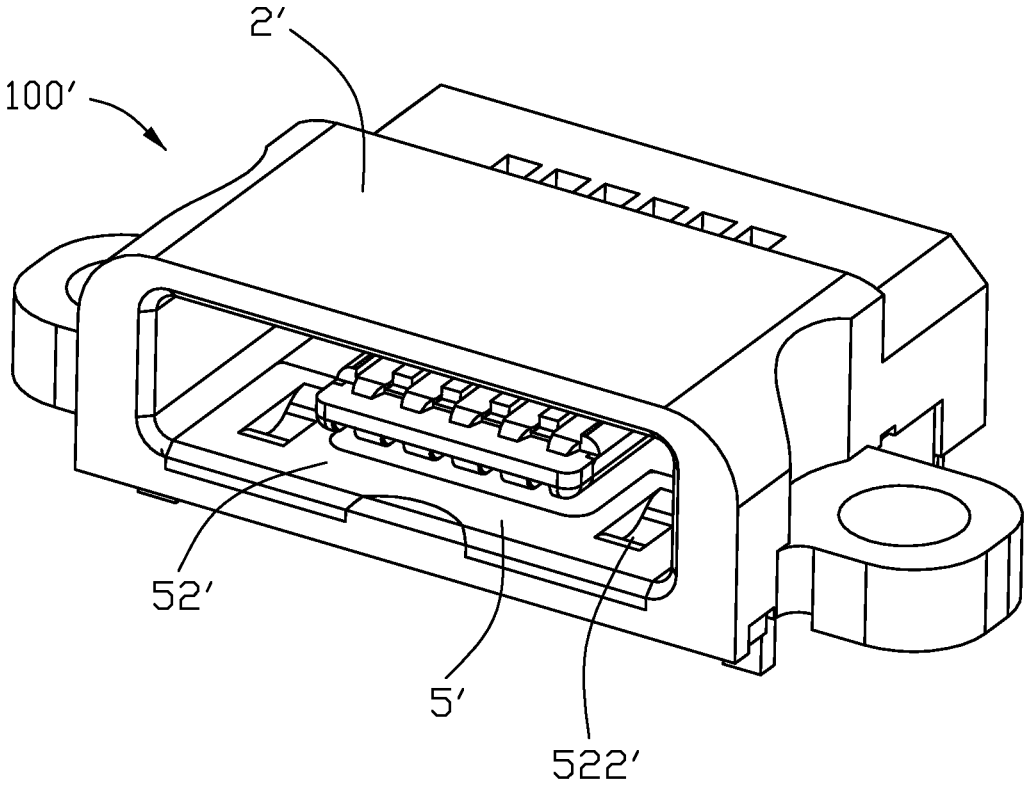
FIG. 6 is a perspective, assembled view of an electrical connector in a second embodiment constructed in accordance with the present invention.
Figure 7:
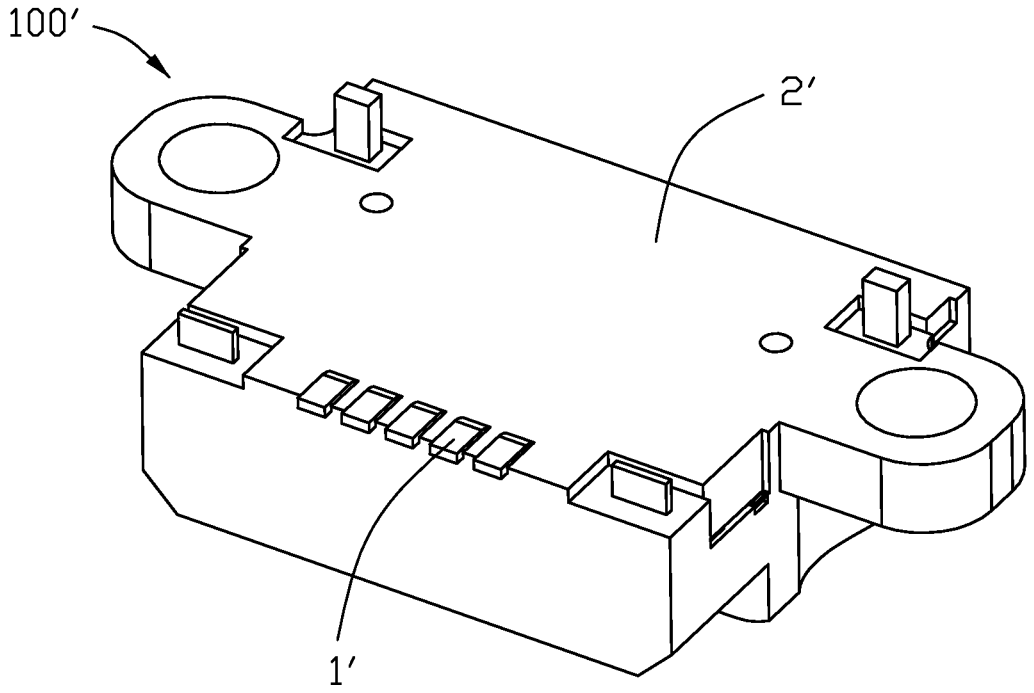
FIG. 7 is similar to but taken a different view from FIG. 6.
Figure 8:
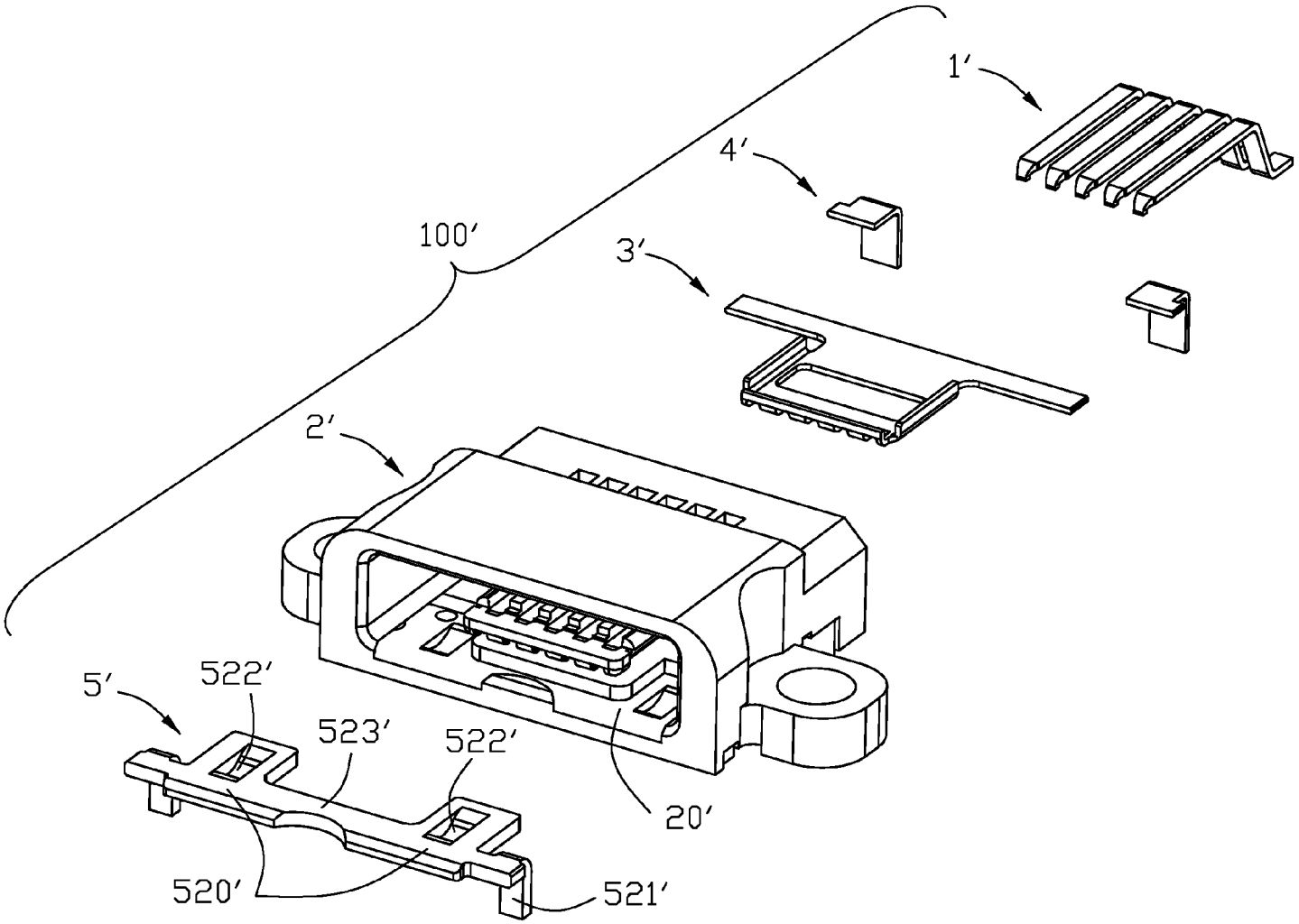
FIG. 8 is a perspective, exploded view of the electrical connector of FIG. 6.
Figure 9:
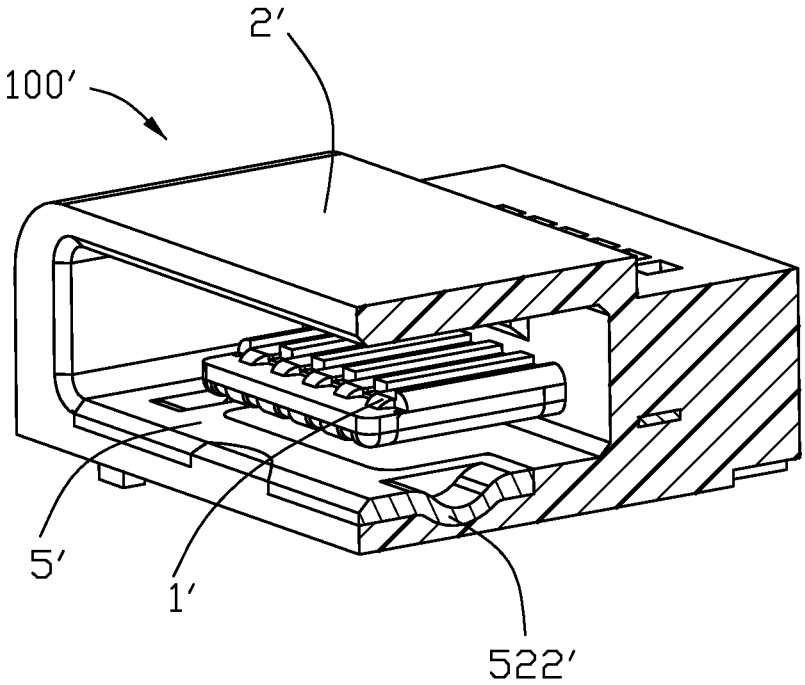
FIG. 9 is a cross-sectional view of the electrical connector when taken along line 9-9 of FIG. 6.

Referring to FIG. 5, each contact 1 comprises a front contacting portion 11 for connecting with the mating plug connector, a retaining portion 12 extending backwardly and slantwise from the front contacting portion 11 for retained in the insulative body 1, and a rear soldering portion 13 extending backwardly and horizontally from the retaining portion 12 for being soldered with a printed circuit board (not shown) of an electronic appliance (not shown) such as a mobile phone which usually has an antenna (not shown) for both transmitting and receiving signals.

Referring to FIGS. 2-5, the insulative body 2 is overmolded outside of the metal shell 5, the contacts 1, the reinforcing plate 3, and the grounding plates 4. The insulative body 2 comprises an upper wall 21, a lower wall 22, a pair of sidewalls 23, and a rear wall 24 connecting between the upper wall 21, the lower wall 22, and the sidewalls 23 for cooperatively defining the receiving space 20. The mating tongue 25 extends forwardly from the rear wall 24 into the receiving space 20. The rear wall 24 defines a plurality of cutouts 241 on an upper face thereof which are formed after a plurality of molds (not shown) is removed. The molds are used for orienting the contacts 1 during molding of the insulative body 2. Therefore, the cutouts 241 extend along a vertical direction perpendicular to the mating tongue 25 which extends along both the front-and-rear direction and a transverse direction perpendicular to the front-and-rear direction. The contacting portions 11 of the contacts 1 extend beyond the mating tongue 25 to be exposed in the receiving space 20 for engaging with the mating plug connector.

Figure 3:
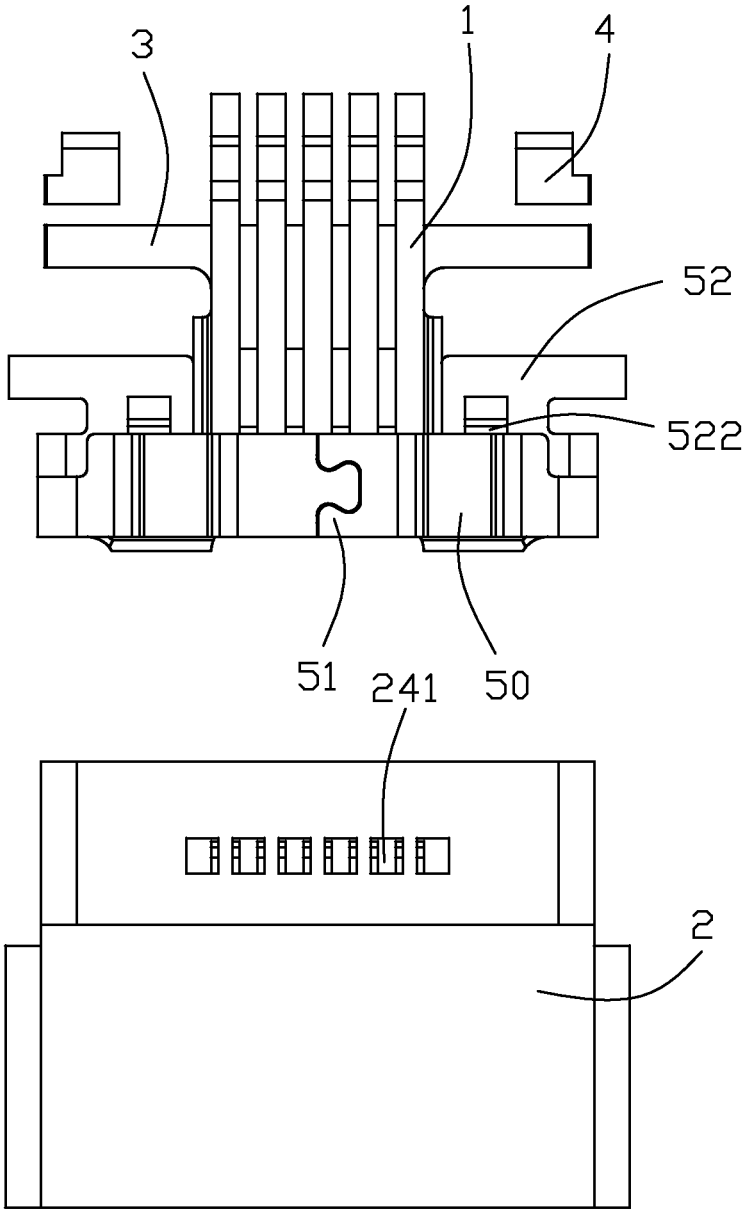
FIG. 3 is a top, elevational view of the electrical connector of FIG. 1 when the insulative body is separated from other parts of the electrical connector.
Figure 4:
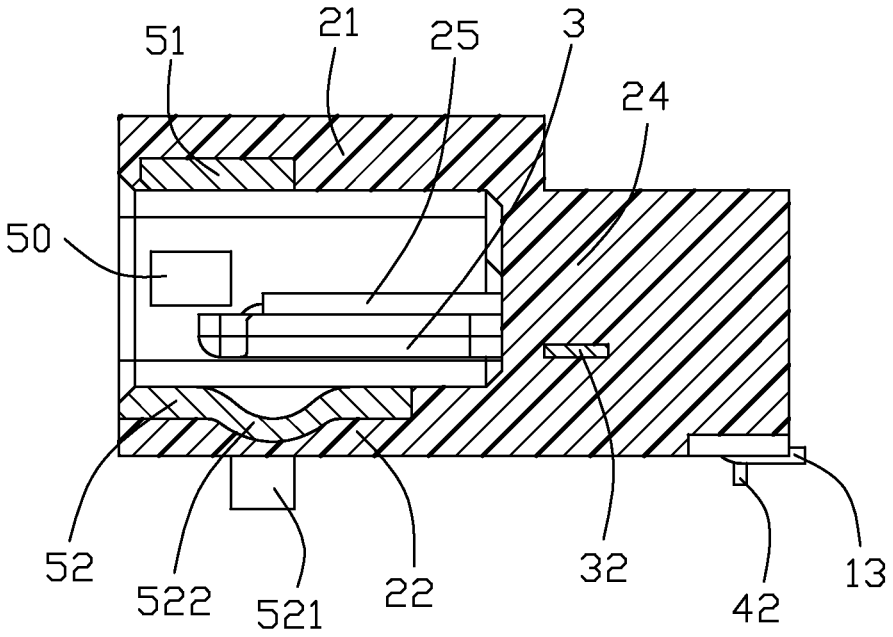
FIG. 4 is a cross-sectional view of the electrical connector when taken along line 4-4 of FIG. 1.

Referring to FIG. 3, the reinforcing plate 3 comprises a base portion 31, a front end portion 33 curvedly extending from a front margin of the base portion 31, a pair of fixing legs 32 extending rearwardly and horizontally from the base portion 31, and a pair of side portions 34 curvedly extending from two lateral margins of the base portion 31. The fixing legs 32 oppositely extend outside of the insulative body 2 along the transverse direction. The base portion 31 is positioned below the mating tongue 25 and the base portion 31 defines a transverse slot 310. The mating tongue 25 extends into the transverse slot 310 for retaining the reinforcing plate 3 with the insulative body 2. The front end portion 33 and the side portions 34 correspondingly and upwardly catch with front and lateral edges of the mating tongue 25 for retaining the reinforcing plate 3 with the insulative body 2, too. The reinforcing plate 3 is made from metal material which is more rigid than plastic material of the insulative body 2, and therefore, the reinforcing plate 3 prevents the mating tongue 25 from accidentally being broken.

Referring to FIG. 3, the grounding plates 4 are retained in the rear wall 24 of the insulative body 2. Each grounding plate 4 comprises a horizontal portion 41 retained in the insulative body 2 and a vertical portion 42 integral with the horizontal portion 41 for connecting with the printed circuit board.

Referring to FIG. 5, the metal shell 5 is a frame shaped and comprises a top wall 51, a bottom wall 52 opposite to the top wall 51, and a pair of opposite lateral walls 53 connecting between the top wall 51 and the bottom wall 52. The bottom wall 52 comprises a pair of board locks 521 extending downwardly therefrom for securing into the printed circuit board. Each of the top wall 51 and the lateral walls 53 forms a bulge 50 protruding inwardly to be planar with an inner surface of the insulative body 2 and so, exposed into the receiving space 20. The top wall 51, the bottom wall 52, and the lateral walls 53 are retained in the insulative body 2 except for the bulges 50 and the board locks 521. When the mating plug connector is inserted in the receiving space 20, the bulges 50 engage with the mating plug connector for preventing the insulative body 2 from being scrapped by the mating plug connector. The bottom wall 52 comprises a pair of locking portions 520 integrating with the corresponding lateral walls 53 and a connection portion 523 connecting between the locking portions 520. Each locking portion 520 forms an arc portion 522 arching outwardly away from the receiving space 20 for engaging with a pair of latches (not shown) of the mating plug connector. According to the first embodiment of the present invention, each of the top wall 51, the bottom wall 52, and the lateral walls 53 has a length along the front-and-rear direction smaller than that of the receiving space 20, namely, the top wall 51, the bottom wall 52, and the lateral walls 53 do not extend to the rear wall 24 of the insulative body 2. Therefore, the electrical connector 100 of the first embodiment reduces antenna interference because of the small length of the metal shell 5 along the front-and-rear direction wherever the antenna is positioned. Alternatively speaking, the metal shell 5 has a length as small as possible extending along the front-and-rear direction for avoiding the antenna. For example, the locking portions 520 are essential because the arc portions 522 of the locking portions 520 are used for engaging with the latches of the mating plug connector, however, a minimum size of the connection portion 523 between the locking portions 521 is 0.

Referring to FIGS. 6-9, the metal shell 5' of the present invention in a second embodiment, is plate shaped and comprises a pair of locking portions 520', a connection portion 523' connecting between the locking portions 520', and a pair of board locks 521' extending downwardly for securing into the printed circuit board. Each locking portion 520' forms an arc portion 522' arching outwardly away from the receiving space 20' for engaging with the mating plug connector. Compared the two embodiments of the present invention, the metal shell 5' of the second embodiment has none of the top wall 51 and the lateral walls 53 of the first embodiment, for more effectively reducing antenna interference consideration.

The metal shell 5, 5' of the present invention which is positioned on at least one of the four insulative walls 21, 22, 23, is vitally and essentially to have a length smaller than that of the receiving space 20 for avoiding the antenna. Therefore, the electrical connector 100 of the present invention reduces interference between the metal shell 5, 5' and the antenna. It is noted that because the connector is made by an insert molding process to have the metallic shell, the metallic reinforcing plate and the metallic contacts are all integrally formed with the insulative housing, each metallic shell and metallic reinforcing plate has two opposite end sections 59, 59' and 39 exposed upon two opposite side walls of the housing for linking to a corresponding carrier during the insert molding process. Understandably, such carrier should be removed after the insert molding process for finalizing the whole connector.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative body comprising an upper wall, a lower wall, a pair of sidewalls, and a rear wall connecting between the upper wall, the lower wall, and the sidewalls for cooperatively defining a receiving space, the insulative body having a mating tongue extending forwardly from the rear wall into the receiving space;

a plurality of contacts retained in the mating tongue and partly exposed in the receiving space for engaging with a mating plug connector;

a metal shell having a length along a front-and-rear direction smaller than that of the receiving space so as to be positioned on a front part of the lower wall for reducing interference between the metal shell and an antenna mounted adjacent the connector, wherein the metal shell comprises a pair of locking portions spaced apart from each other and each locking portion forming an arc portion arching outwardly away from the receiving space for engaging with a pair of latches of the mating plug connector.

2. The electrical connector as claimed in claim 1, wherein the metal shell extends to the sidewalls and the upper wall of the insulative housing.

3. The electrical connector as claimed in claim 2, wherein the metal shell has a top wall, a bottom wall, and a pair of lateral walls connecting between the top wall and the bottom wall, all of the top wall, the bottom wall, and the lateral walls being distanced from the rear wall of the insulative body.

4. An electrical connector assembly comprising:

an insulative housing defining a receiving space communicating with an exterior along a front-to-back direction, and a tongue portion extending forwardly in the receiving space and forming opposite surfaces in a vertical direction perpendicular to said front-to-back direction;

a plurality of contacts disposed in the housing with contacting sections exposed upon one surface of the tongue portion;

a metallic reinforcing plate attached upon the other surface of the tongue portion;

a metallic shell attached to the housing and including a wall located on a corresponding side of the receiving space, said wall equipped with a pair of recessed locking portions spaced from each other in a transverse direction perpendicular to both said front-to-back direction and said vertical direction for locking to a pair of latches of a plug connector; wherein said metallic shell is dimensioned smaller than the receiving space in the front-to-back direction for reducing interference between the metallic shell and an antenna mounted adjacent the connector, wherein said metallic shell includes a pair of board locks extending downwardly in the vertical direction beyond a bottom face of the housing for mounting to a printed circuit board, wherein said metallic shell is integrally formed with the housing via an insert molding process, and includes in the transverse direction a pair of spaced end sections exposed on two opposite lateral side walls of the housing for linking to a carrier during the insert molding process thereabouts.

5. The electrical connector assembly as claimed in claim 4, wherein said metallic shell forms a frame structure essentially surrounding the receiving space viewed along the front-to-back direction.

6. The electrical connector assembly as claimed in claim 5, wherein said frame structure is not fully exposed in the receiving space but with transversely spaced bulged portions coplanar with an interior surface of said housing and with in the transverse direction a connection portion between the pair of recessed locking portion commonly coplanar with an opposite interior surface of the housing.

7. The electrical connector assembly as claimed in claim 4, wherein said metallic shell further includes a pair of board locks located adjacent to the corresponding end sections and extending downwardly beyond a bottom face of the housing for mounting to a printed circuit board.

8. The electrical connector as claimed in claim 7, wherein said pair of board locks are located in front of the pair of end sections in the front-to-back direction.

9. The electrical connector assembly as claimed in claim 4, wherein the metallic reinforcing plate is integrally formed with the housing via said insert molding process, and includes in the transverse direction a pair of spaced end sections exposed on said two opposite lateral side walls of the housing for linking to a carrier during the insert molding process.

10. The electrical connector assembly as claimed in claim 9, wherein the pair of end sections of the reinforcing plate are located behind those of the metallic shell in the front-to-back direction.

11. The electrical connector assembly as claimed in claim 4, further including a printed circuit board on which the housing is mounted, wherein the metallic reinforcing plate is located farther from the printed circuit board than said wall is in the vertical direction, and is located between the contacts and said wall in said vertical direction.

12. The electrical connector assembly as claimed in claim 4, wherein said wall is a bottom wall of the metallic shell, and the corresponding side of the receiving space is closer to a printed circuit board, on which the connector is seated, than an opposite side of said receiving space.

13. The electrical connector assembly as claimed in claim 4, wherein said wall defines a inwardly curved recess in a front edge and between said two locking portions for receiving the housing therein.

14. An electrical connector assembly comprising:

an insulative housing defining a receiving space communicating with an exterior along a front-to-back direction, and a tongue portion extending forwardly in the receiving space and forming opposite surfaces in a vertical direction perpendicular to said front-to-back direction;

a plurality of contacts disposed in the housing with contacting sections exposed upon one surface of the tongue portion;

a metallic reinforcing plate attached upon the other surface of the tongue portion;

a metallic shell attached to the housing and including a bottom wall located on a bottom side of the receiving space, said bottom wall equipped with a pair of recessed locking portions spaced from each other in a transverse direction perpendicular to both said front-to-back direction and said vertical direction for locking to a pair of latches of a plug connector; and a printed circuit board on which the housing is seated; wherein both the metallic reinforcing plate and the metallic shell are integrally formed with the housing via an insert molding process with opposite end sections exposed to an exterior for linking corresponding carrier; wherein the bottom wall of the metallic shell is closer to the printed circuit board than the metallic reinforcing plate is in the vertical direction.

15. The electrical connector assembly as claimed in claim 14, wherein said metallic shell is only applied to said side of the receiving space.

16. The electrical connector assembly as claimed in claim 14, wherein said shell is dimensioned smaller than the receiving space in the front-to-back direction.

17. The electrical connector assembly as claimed in claim 14, wherein said bottom wall includes, between the spaced recessed locking portions, a cutout filled with material of the housing.

* * * * *